United States Patent [19]

Crosby et al.

[11] 4,247,089

[45] Jan. 27, 1981

[54] SPRING CONSTRUCTION

[75] Inventors: Lawton H. Crosby; M. P. Ferris, both of Lake Bluff; Kurt Melzer, Chicago, all of Ill.

[73] Assignee: Morley Furniture Spring Construction, Lake Bluff, Ill.

[21] Appl. No.: 949,080

[22] Filed: Oct. 6, 1978

Related U.S. Application Data

[63] Continuation-in-part of Ser. No. 730,631, Oct. 7, 1976, abandoned.

[51] Int. Cl.[3] ..... F16F 3/00; A47C 27/08

[52] U.S. Cl. ..... 267/105; 5/247; 267/110

[58] Field of Search ..... 267/102, 103, 104, 105, 267/109, 110, 111, 112; 5/247, 255, 261, 263, 266

[56] References Cited

U.S. PATENT DOCUMENTS

| | | | |
|---|---|---|---|
| 2,218,708 | 10/1940 | Hakerstump | 267/110 |
| 2,657,740 | 11/1953 | Daniels et al. | 267/105 |
| 3,200,417 | 8/1965 | Costello | 5/261 |
| 3,667,749 | 6/1972 | Platt et al. | 267/112 |
| 3,982,737 | 9/1976 | Platt et al. | 267/102 |
| 3,998,442 | 12/1976 | Keane et al. | 267/105 |

FOREIGN PATENT DOCUMENTS

| | | | |
|---|---|---|---|
| 157777 | 1/1953 | Australia | 267/105 |
| 496385 | 11/1927 | Fed. Rep. of Germany | 267/110 |
| 1312613 | 11/1962 | France | 267/105 |

*Primary Examiner*—Edward R. Kazenske
*Attorney, Agent, or Firm*—Richard G. Lione

[57] ABSTRACT

A seat spring assembly having sinuous spring bands wherein the outermost band adjacent a side rail is provided supplemental resilient resistance to deflection by a combination of a trust member and a key member. As a result, a uniform spacing can be maintained between the bands across the entire seat frame.

10 Claims, 14 Drawings

SPRING CONSTRUCTION

RELATED APPLICATION

This application is a continuation-in-part of application Ser. No. 730,631, filed Oct. 7, 1976, now abandoned.

FIELD OF THE INVENTION

This invention is in the field of seat spring assemblies for furniture seats and the like. It relates particularly to seat spring assemblies which employ sinuous spring bands.

BACKGROUND OF THE INVENTION

It is important in springing sofas and loveseats, for example, that a person sitting at either end does not feel the unpleasant sensation of "lean-out" over the arm. "Lean-out" is caused by the difference between the strong spring support he gets underneath him on his inboard side and the virtual absence of support he gets from the absence of springs on his outboard side.

For over forty years, the presence of a high degree of "lean-out" has been particularly troublesome when springing sofas, loveseats, sectionals and similar furniture with sinuous springs of any type. The problem is even more bothersome in open-end modular styles, where there is no arm at either one end or both ends. Many attempts have been made to combat this problem but none have been fully successful, even when going to the extreme in labor and materials costs of placing two or even three sinuous spring bands at each arm end so close together as to virtually touch each other and as far out under the arm as possible. This construction is expensive because of the additional spring and labor required, it puts great additional strain on the furniture frame at the point of attachment of the additional spring, and it has the effect of slowing down the subsequent upholstering process.

SUMMARY OF THE INVENTION

The present invention, for the first time, fully accomplishes arm-end spring support, even in open-end modular styles. Furthermore, this arm-end spring support is far greater than the spring support provided in any other part of the spring seat. The invention prevents any feel of lean-out while requiring only one sinuous spring band at each arm-end, thus saving the manufacturer the labor and material costs of the two or more eliminated springs. Furthermore, this single sinuous spring band does not need to be placed inconveniently far out under the arm structure. The construction of the present invention permits uniform spacing from left to right in the seat, saving additionally that labor time required in mounting springs in a non-uniformly spaced arrangement.

The foregoing and other objects of the invention are realized by providing a span and key support to the bow or arc of an installed sinuous spring band. The span structure in its simplest form comprises a semi-rigid span member extending between the front and back frame rails or the front and back ends of the spring band. A rigid key member is disposed between the span member and the band. The key member transmits the downward thrust of the band to the span member. Severely limited and controlled downward deflection of the band under load is achieved.

BRIEF DESCRIPTION OF THE DRAWINGS

The invention, including its construction and method of operation, together with additional objects and advantages thereof, is illustrated more or less diagrammatically in the drawings, in which.

DESCRIPTION OF THE PREFERRED EMBODIMENTS

Figure 1:
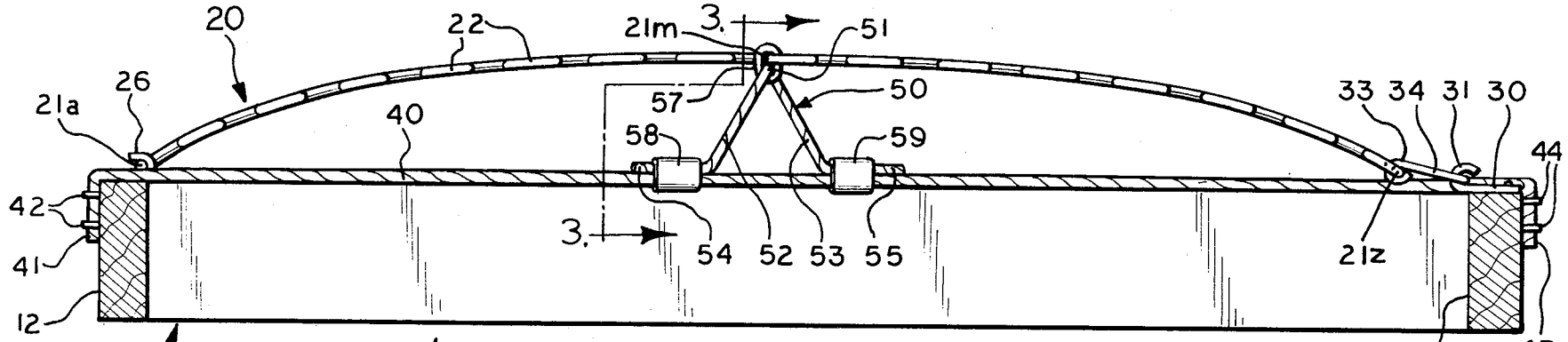
FIG. 1 is a vertical sectional view of a seat spring assembly embodying features of a first form-first version of the invention, with parts removed.
Figure 2:
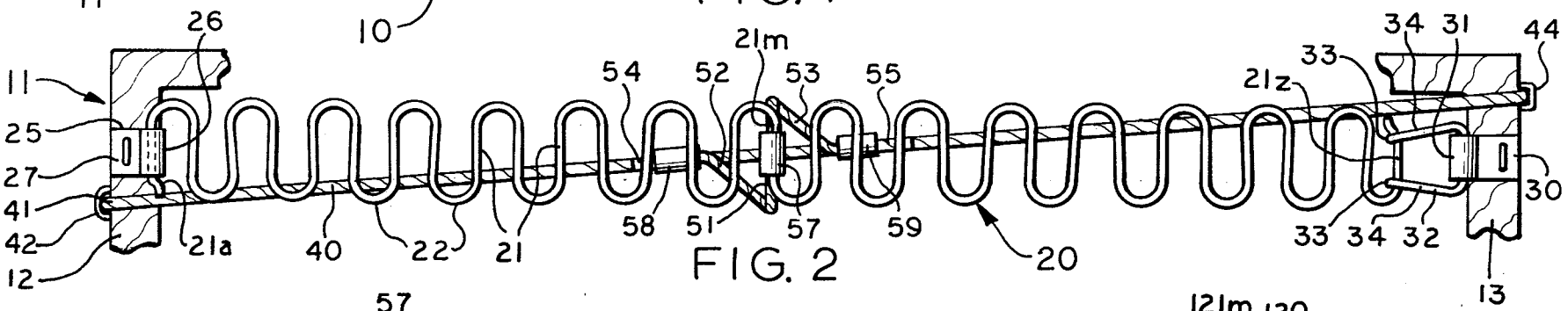
FIG. 2 is a top plan view of the assembly illustrated in FIG. 1.
Figure 3:
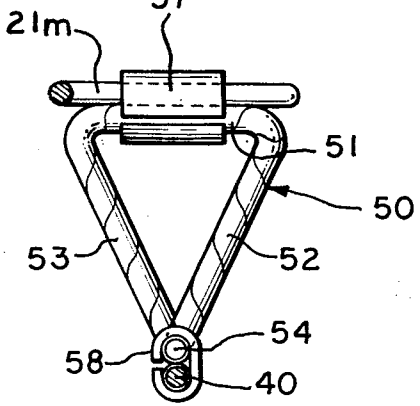
FIG. 3 is a sectional view taken along line 3—3 of FIG. 1.

Referring now to the drawings, and particularly to FIGS. 1–3, a seat spring assembly embodying features of a first form-first version of the present invention is illustrated generally at 10. The seat spring assembly is, according to the invention, specially adapted for use adjacent the ends of sofas or loveseats or the like to prevent "lean-out" by a seated person outwardly over the arm.

The seat spring assembly 10 includes a wood frame 11 having a vertically disposed front rail 12, a corresponding back rail 13 and interconnecting side rails (one shown). Extending between the front rail 12 and the back rail 13, parallel to the side rails are a plurality of identical sinuous spring bands 20, only one of which is shown. Each of the bands 20 is generally conventional in construction and includes a parallel series of generally linear wire segments 21 interconnected by a series of generally semi-circular wire segments 22 in a "sinuous" configuration.

In the seat spring assembly 10, the forwardmost linear wire segment 21*a* is seated in a conventional mounting clip 25 which attaches the band 20 to the front rail 12. The clip 25 includes a hook 26 in which the wire segment 21*a* is seated and a horizontally extended attachment section 27 which is apertured to receive a staple or the like to fasten the clip to the upper surface of the front rail 12.

In the spring assembly 10, the rearwardmost linear wire segment 21*z* is fastened to the back rail 13 in slightly different fashion. Here a clip 30 identical to the clip 25 is fastened to the back rail in the same manner. Seated in the hook 31 of the clip 30, however, is a U-shaped link 32 which, in turn, has hooks 33 formed at the free ends of each of its two legs 34. The linear wire segment 21*z* is seated in the hooks 33 in the manner illustrated.

The spring band 20 may be conventional, pre-arced sinuous which is stretched into an extended, albeit still arced, relationship to be fastened to the rails 12 and 13. It may, on the other hand, be a conventional fully or partially de-arced sinuous spring band. The loop size of the band might vary widely also. Although the band 20 illustrated is "regular" loop sinuous, it might also be "X-L" (extra large) or "S-L" (super loop) sinuous. The invention also can be employed with conventional "zigger" configuration springs, and similar types.

According to the invention, a stiff wire span member 40 spans the frame between the front rail 12 and the back rail 13 in this first form-first version of the invention and is rigidly fastened to these rails at its opposite ends. The wire span member 40, which thus subtends the arc of the band 20, comprises conventional paper-covered wire which is formed downwardly at its front end, as at 41, and fastened with the aid of staples 42 to the front surface of the front rail 12. The member 40 is also formed downwardly adjacent its back end, as at 43, and fastened to the back surface of the back rail 13 with staples 44. The wire span member 40 may also be fastened with the aid of staples to the top surfaces of the rails 12 and 13, respectively.

Referring to FIG. 2, it will be seen that the front end 41 of the wire span member 40 is fastened to the rail on one side of the sinuous spring band while the back end 43 is fastened to the outer surface of the back rail 13 on the other side of the band. The effect is to cause the wire member 40 to pass diagonally under the sinuous spring band. This permits the wire member 40 to be centered under band at approximately the mid-point of the band while having its ends fastened to the rail at points laterally displaced from the band so that the member 40 does not interfere with vertical movement of the spring band adjacent the rails.

Mounted on the wire span member 40 approximately intermediate its ends, and fastened to the sinuous spring band 20 approximately intermediate its ends, is a "key" member 50 formed also of paper-covered wire. The "key" member 50 is bent irregularly in the shape illustrated in FIG. 3 so as to have when mounted in position as illustrated in FIGS. 1–3, a horizontal mid-segment 51 corresponding in length substantially to the transverse or width dimension of the sinuous spring band 20, downwardly and inwardly inclined side segments 52 and 53, and horizontally disposed end segments 54 and 55 in line with each other and extending parallel to the wire span member 40.

The mid-segment 51 is fastened to one of the parallel wire segments 21, the segment 21*m* in the present illustration, by a conventional sleeve clamp 57. The end segment 54 is, in turn, fastened securely to the wire span member 40 by a similar sleeve clamp 58 while the end segment 55 is fastened to the wire span member 40 by another sleeve clamp 59. At the points intermediate the span member 40 ends where the end wire segments 54 and 55 are fastened the span member is approximately centered under the band 20 in its diagonal path from side-to-side of the band. The clamps 57, 58 and 59 are applied by a workman assembling the spring asembly 10 in a well-known manner with a conventional sleeve clamp gun.

In operation of the spring assembly 10, when a load is imposed on the single sinuous spring band 20 at one end of the sofa or loveseat, for example, and the load tends to force the band 20 downwardly, the downward thrust is communicated through the "key" member 50 to the span member 40. Because the span member is oil tempered, twelve gauge wire which is relatively stiff, and it is fastened securely at either end, only a limited; i.e. controlled amount of downward deflection can take place. This controlled deflection is limited to about three quarters (3/4) of an inch. Accordingly, a person who sits adjacent the end of a sofa or loveseat, for example, does not tilt or lean outwardly over the arm as a result of a collapse of the endmost sinuous spring band.

In this first form-first version of the invention, the "key" member 50 is so bent that the load is spread on the span member 40 but not on the spring band 20. This load spreading is achieved through the longitudinally displaced end segments 54 and 55 of the key member 50 and their attachment to the wire span member 40.

Figure 4:
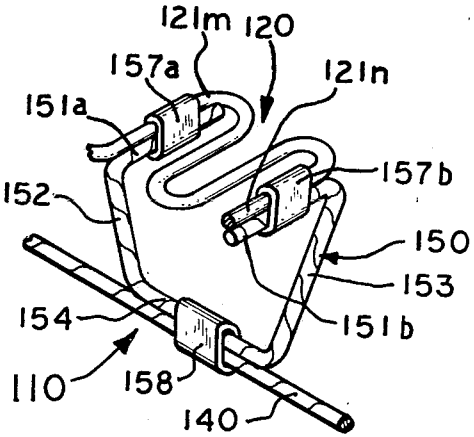
FIG. 4 is a perspective view of a portion of a first form-second version of the seat spring assembly embodying features of the present invention.

A first form-second version of the seat spring assembly embodying features of the present invention is seen generally at 110 in FIG. 4. The assembly 110 differs from the seat spring assembly 10 hereinbefore discussed only in configuration, mounting and, to some extent, the operation of the "key" member; in this assembly designated at 150. Accordingly, only the portion of the assembly 110 including the "key" member 150 is shown.

The "key" member 150 is mounted on the wire span member 140 approximately intermediate its ends and fastened to the sinuous spring band 120 approximately intermediate its ends. Once again, the "key" member 150 is formed of paper-covered wire. It is bent irregularly so as to have, when mounted in the position therein illustrated, a pair of horizontal end segments 151*a* and 151*b* corresponding in length substantially to the transverse or width dimension of the sinuous spring band 20, downwardly and inwardly inclined side segments 152 and 153, and a horizontally disposed mid-segment 154 in line with and extending parallel to the wire span member 140.

The end segments 151*a* and 151*b* are fastened to corresponding ones of the band's parallel wire segments 121, the segments 121*m* and 121*n* in the present illustration, by conventional sleeve clamps 157*a* and 157*b*. The mid-segment 154 is, in turn, fastened securely to the wire span member 140 by a similar sleeve clamp 158.

In operation of the spring assembly 110, when a load is imposed on the single sinuous spring band 120 at one end of the sofa or loveseat, for example, the load tends to force the band 120 downwardly. The downward thrust is communicated through the "key" member 150 to the span member 140. As a result, a person who sits adjacent the end of a sofa does not tilt or lean outwardly over the arm.

In this first form-second version of the invention, the "key" member 150 is so bent that the load is spread on the spring band 120, but not on the span member 140. This is achieved through the longitudinally displaced end segments 151*a* and 151*b* of the "key" member 150 and their attachment to the spring band 120, and on the elongated mid-segment 154 of the "key" member.

Figure 5:
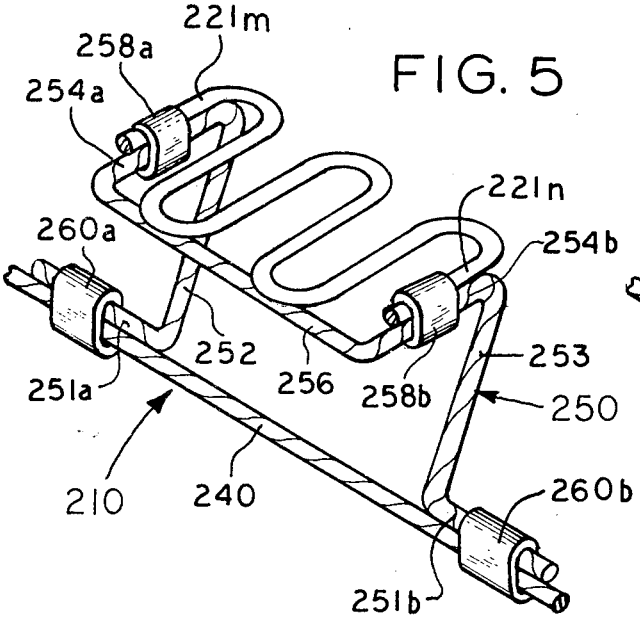
FIG. 5 is a perspective view, similar to FIG. 4, illustrating a portion of a first form-third version of the seat spring assembly embodying features of the present invention.

A first form-third version of the seat spring assembly embodying features of the invention is seen generally at 210 in FIG. 5. The assembly 210 differs from the assemblies 10 and 110, once again, only in configuration, mounting and, to some extent, the operation of the "key" member; in this assembly designated as 250. Again, only the portion of the assembly 210 including the "key" member 250 is shown.

The "key" member 250 is mounted on the wire span member 240 approximately intermediate its ends and fastened to the sinuous spring band 220 approximately intermediate its ends. The "key" member 250 is formed of paper-covered wire. It is bent irregularly so as to have, when mounted in the position therein illustrated, a pair of horizontal end segments 251*a* and 251*b* extending parallel to the wire span member 240, upwardly and outwardly inclined side segments 252 and 253, a pair of horizontal intermediate segments 254*a* and 254*b* corresponding in length substantially to the transverse or width dimension of the sinuous spring band 220, and a horizontally disposed mid-segment 256 joining the intermediate segments 254*a* and 254*b*.

The intermediate segments 254*a* and 254*b* are fastened to corresponding ones of the band's parallel wire segments 221, the segments 221*m* and 221*n* in the present illustration, by conventional sleeve clamps 258*a* and 258*b*. The end segments 251*a* and 251*b* are, in turn, fastened securely to the wire span member 240 by similar sleeve clamps 260*a* and 260*b*. This version spreads the load on both the span 240 and on the spring band 221.

Figure 6:
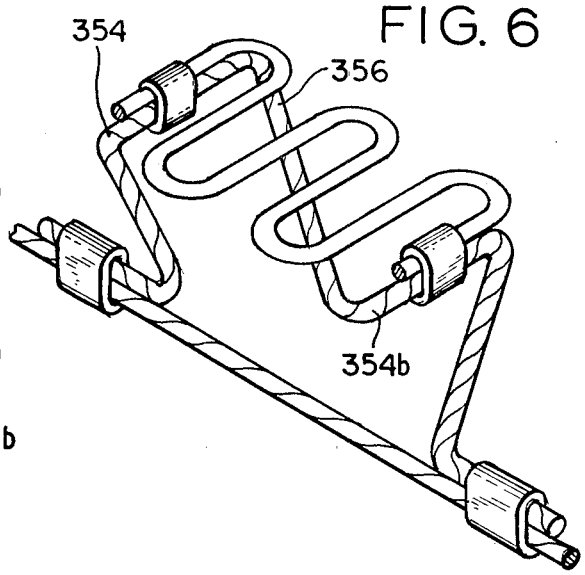
FIG. 6 is a perspective view of a portion of a first form-fourth version of a seat spring assembly embodying features of the invention.

A first form-fourth version of the seat spring assembly embodying features of the invention is seen generally at 310 in FIG. 6. The assembly 310 differs from the assembly 210 immediately hereinbefore described only in that the mid-segment 356 of the "key" member 350 extends diagonally across the width of the sinuous spring band 320 and interconnects the intermediate segments 354*a* and 354*b* of the "key" member, rather than along one side of the band. The operation and effect, including load spreading of the assembly is, for all practical purposes, identical to that of the assembly 210.

Figure 7:
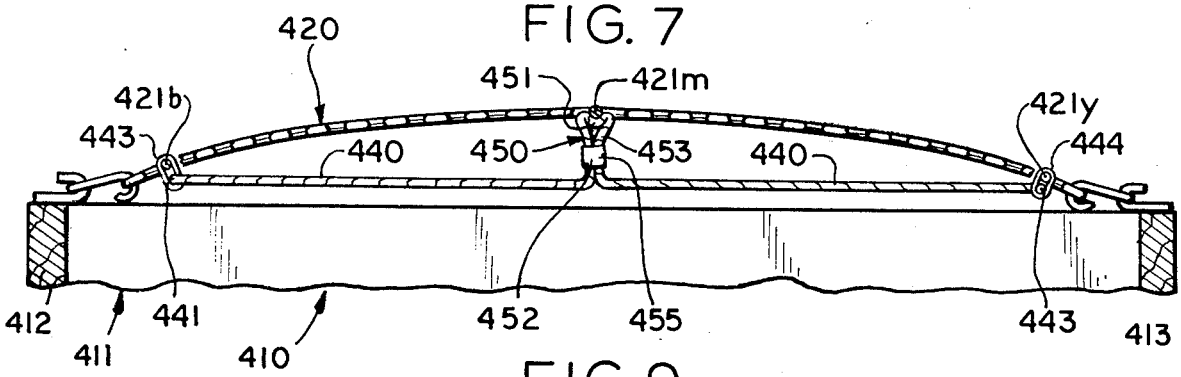
FIG. 7 is a vertical sectional view through a seat spring assembly embodying features of a second form of the present invention, with parts removed.
Figure 8:
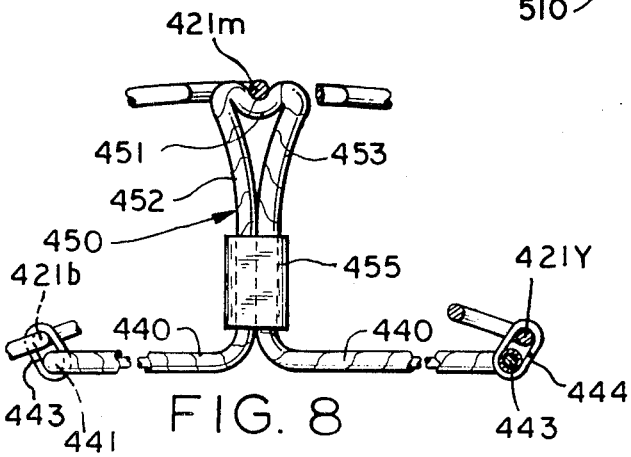
FIG. 8 is an enlarged vertical sectional view of a portion of the seat spring assembly illustrated in FIG. 7, with parts broken away.

Referring now to FIGS. 7 and 8, a seat spring assembly embodying features of a second form of the present invention is illustrated generally at 410. Like those hereinbefore discussed, the seat spring assembly 410 is specially adapted for use adjacent the ends of sofas or loveseats or the like to prevent "lean-out".

The seat spring assembly 410 is, insofar as its wood frame 411 and the mounting of its sinuous spring band 420 is concerned, substantially identical to the construction described in relation to the first forms of the present invention. Accordingly, corresponding reference numerals are used to identify corresponding components, with the further addition of 100 digits to distinguish the assemblies. For example, the front rail of the seat spring assembly 410 is identified by the reference numberal 412, while the back rail is 413.

In the seat spring assembly 410, a wire span member 440 substantially spans the frame between the front rail 412 and the back rail 413 but, in this case, it is fastened at its opposite ends to the penultimate linear segments 421*b* and 421*y*, respectively, rather than to the frame rails. The wire span member 440 again comprises conventional paper-covered wire, however. The span member 440 is bent in one sideways direction at its front end, as at 441, and fastened with the aid of a sleeve clamp 443 to the linear wire segment 421*b*. The member 440 is also bent sidewardly, albeit in the opposite direction, adjacent its back end, as at 443, and fastened to the penultimate linear wire segment 421*y* with a sleeve clamp 444. Alternative, the ends of the span 440 could be stapled to the rails directly, as hereinbefore described, of course. Once again, the wire span member 440 is mounted so that it passes diagonally under the sinuous spring band.

Formed upwardly in the wire span member 440 approximately intermediate its ends and seated against the sinuous spring band 420 approximately intermediate its ends, is a "key" segment 450. The "key" segment 450 is bent irregularly so as to have two substantially vertical side segments 452 and 453 topped by a "saddle-like" mid-segment 451.

The saddle-like mid-segment 451 seats against an intermediate linear wire segment 421*m* to support the band 420 from the span member 440. Immediately adjacent the horizontal stretch of the span member 440, the vertical side segments 452 and 453 are tightly fastened together by a sleeve clamp 455 in a conventional manner.

In operation of the spring assembly 410, when a load is imposed on the single sinuous spring band 420 at one end of the sofa or loveseat, for example, the load tends to force the body of the band 420 downwardly. This downward force component is translated outwardly in the band 420 to its opposite end connections with the span 440 at the clamps 443 and 444. The stiffness of the span resists deflection of the band through these connections initially. The key element 450 cooperates with the span in resisting deflection and limiting it to a controlled three quarter inches (¾") between clamp 443 and 444.

In this second form-first version of the invention, the "key" element 450 is arranged so that the load is actually not spread out on either the span member 440 or the spring band 420. Nevertheless, an excellent result is achieved in sinuous spring band support. The translation connections (unnumbered) between the band 420 and the frame rails do permit additional downward movement of the entire spring assembly but this is also limited and this form of the invention is used only where spring end translation is desirable.

Figure 9:
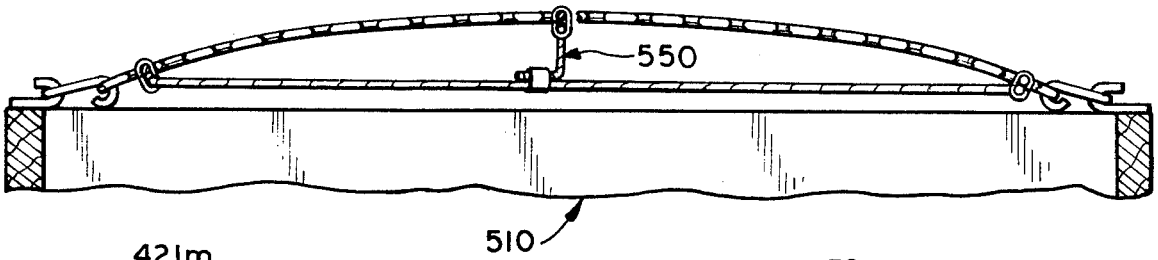
FIG. 9 is a vertical sectional view similar to FIG. 7 illustrating a third form-first version of the seat spring assembly embodying features of the invention.
Figure 10:
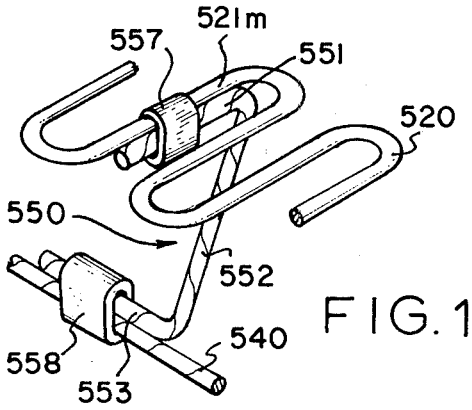
FIG. 10 is a perspective view of a portion of the seat spring assembly illustrated in FIG. 9.

A third form-first version of the spring assembly embodying features of the invention is seen generally at 510 in FIGS. 9 and 10. The assembly 510 differs from the assembly 410 only in the configuration, mounting and, to some extent, effect of the "key " segment or member; in this assembly designated as 550.

The "key" member 550 is, unlike the "key" segment 450, a separate element. It comprises a segment of paper-covered wire having an upper end segment 551 extending parallel to and underneath a linear wire segment 521*m* of the spring band 520. An intermediate leg segment 552 extends substantially vertically down to the wire span member 540. Extending horizontally in parallel relationship to the wire span member 540 is an elongated lower end segment 553 of the "key" member 550.

The upper end segment 551 is fastened to the parallel wire segment 521*m* by a conventional sleeve clamp 557. The lower end segment 553 is, in turn, fastened to the wire span member 540 by a similar sleeve clamp 558. At the point intermediate the span member 540 ends where the end wire segments 551 and 553 are fastened to the span member and the band 520 it is approximately centered under the band in its diagonal path from side-to-side of the band.

Like the "key" element 450 in the seocnd form-first version of the invention, the key element 550 does not spread the load on either the span member 540 or the spring band 520. Nevertheless, the most desirable support results of the invention are achieved.

Figure 11:
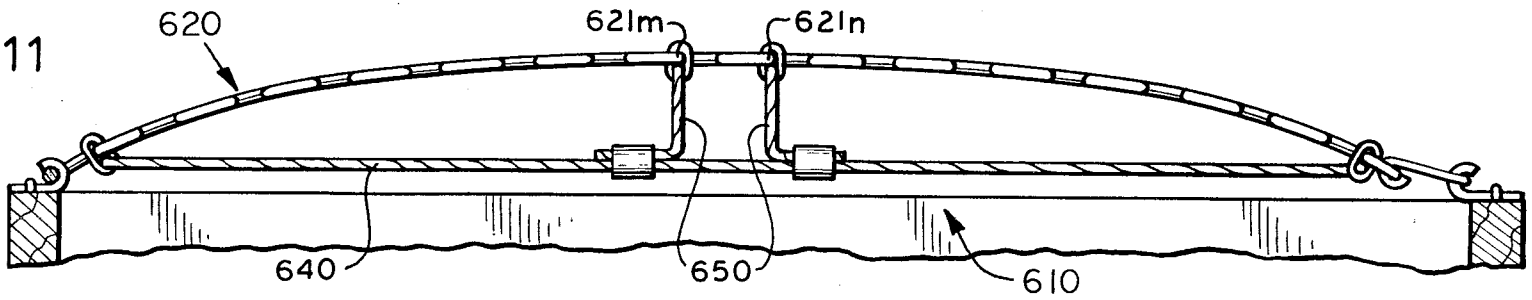
FIG. 11 is a vertical sectional view through a third form-second version of the seat spring assembly embodying features of the invention.

A third form-second version of the seat spring assembly embodying features of the invention is seen generally at 610 in FIGS. 11. Once again, the assembly 610 differs from the assembly 510 only in the configuration, mounting and, to some extent, effect of two "key" members 650 rather than one.

The "key" members 650 are each identical to the "key" member 550. They are mounted in opposed relationship and the band 620. A somewhat mechanically stronger support results, albeit somewhat more expensive also, of course.

Figure 12:
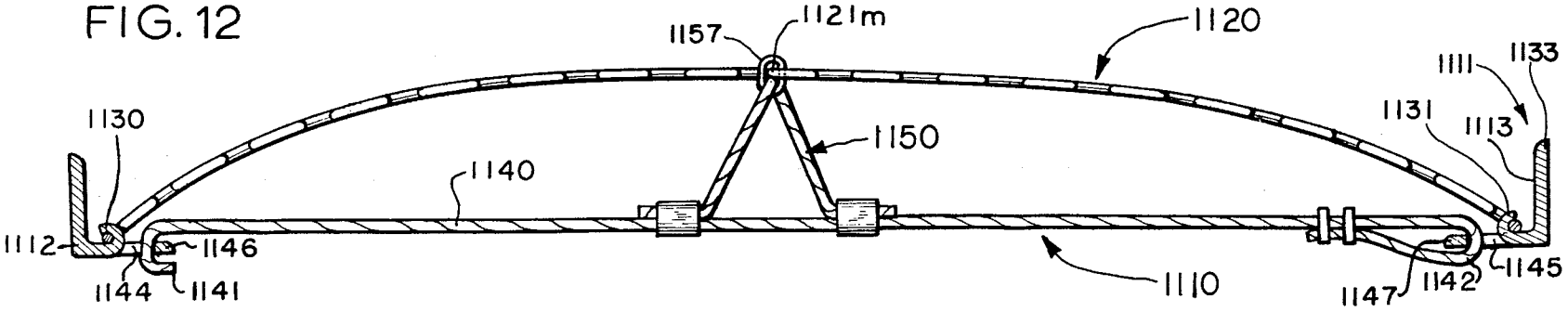
FIG. 12 is a vertical sectional view through a fourth form of the seat spring assembly embodying features of the invention with parts removed.

A fourth form of the seat spring assembly embodying features of the invention is seen generally at 1110 in FIG. 12. The assembly 1110 is substantially identical to the assembly 10 first discussed in this application, differing only in that it includes a steel angle or channel frame 1111 rather than a wood frame.

The steel frame 1111 includes angle members 1112 forming the front rail and 1113 forming the back rail. The sinuous spring band 1120 is stretched between clips 1130 and 1131 which are formed upwardly out of the horizontal flanges 1146 and 1147 respectively of the front and back rails 1112 and 1113.

A twelve gauge, paper covered, relatively stiff wire member 1140 spans the frame between the steel front rail 1112 and back rail 1113 and is formed back upon itself, as at 1141 in the front and 1142 in the back, through apertures 1144 and 1145, respectively, in the horizontal flanges 1146 and 1147 of the rails 1112 and 1113. The apertures 1144 and 1145 remain when the slits 1130 and 1131 are formed, of course. Thus, the span member 1140 is rigidly fastened to the rails 1112 and 1113.

Alternatively, the span can be bare wire at each end. In either case, the wire span member 1140 mounts a "key" member 1150 in a manner identical to the assembly 10 hereinbefore discussed. The "key" member 1150 is fastened to the linear segment ll21*m* of the sinuous spring band 1120 by conventional sleeve clamp 1157. Any of the "key" members heretofore described can be installed.

The operation of the spring assembly 1110 is virtually identical to that of the spring assembly 10. Accordingly, it is not discussed in any detail here except to point out again that it permits only controlled downward deflection of the spring band 1120.

Figure 13:
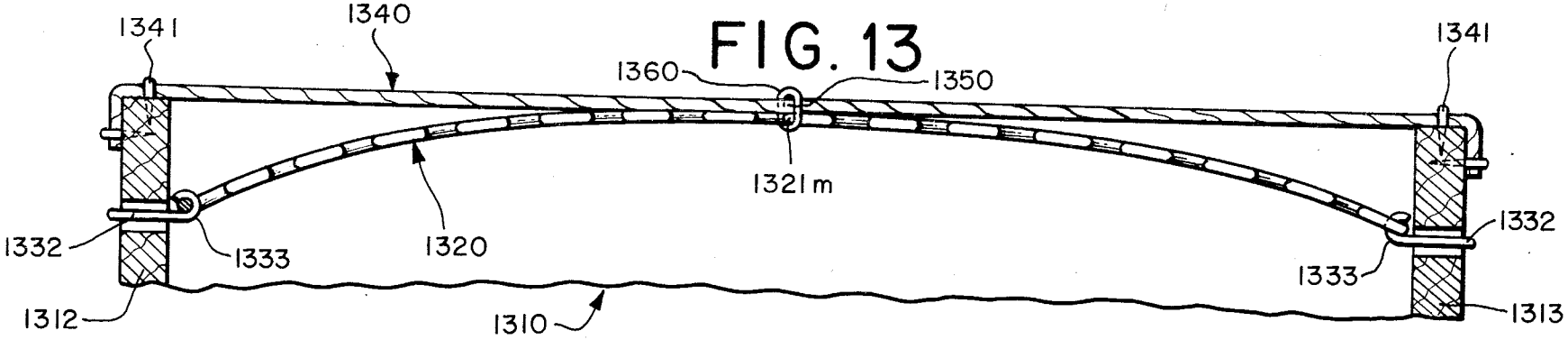
FIG. 13 is a vertical sectional view through a fifth form of the seat spring assembly embodying features of the present invention.

Referring now to FIG. 13, a fifth form of the seat spring assembly embodying features of the invention is illustrated generally at 1310. The seat spring assembly 1310 includes a wood front rail 1312 and a wood back rail 1313, each gang-bored to seat anchor links 1332 corresponding to the anchor links 32 hereinbefore discussed and illustrated in FIGS. 1 and 2.

The anchor links 1332 have their free-end clips 1333 oriented upwardly and the opposite ends of a conventional sinuous spring band 1320 are seated in these clips, as illustrated. According to the invention, a single span member 1340 formed of paper-covered wire spans the rails 1312, 1313 above the sinuous spring band 1320, and is securely stapled to the rails at 1341 adjacent its opposite ends. The span member 1340 has a lateral "jog" 1350 in it which is fastened to a transverse linear segment 1321*m* of the spring band 1320 intermediate its ends by a conventional sleeve clamp 1360.

This tenth form of the seat spring assembly 1310 is a single "travel-limiting truss". It is of value where there is mechanical interference from the stuffing or pull rail of a furniture frame, or where one or both rails are gang-bored. It supports the band 1320 through its "short key"; i.e. the sleeve clamp 1360 and limits travel so that the spring can only undergo controlled deflection of the same order as the FIG. 1 form hereinbefore discussed.

Figure 14:
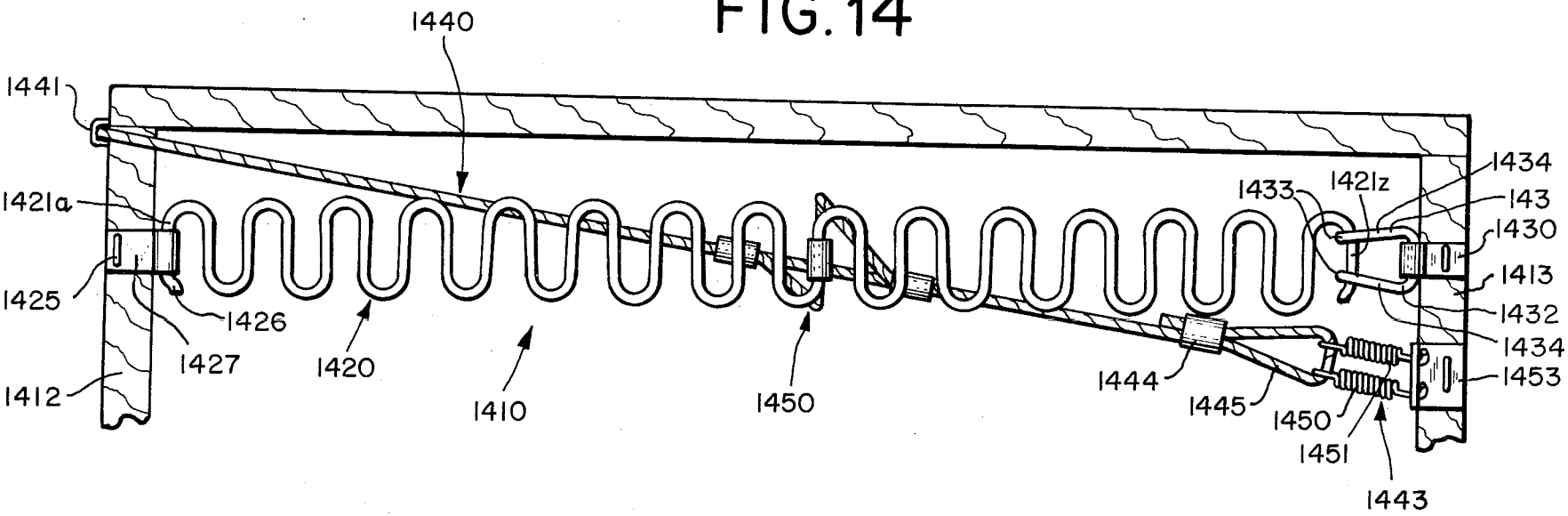
FIG. 14 is a top plan view of a sixth form of the seat spring assembly embodying features of the invention

Referring now to FIG. 14, a sixth form of the seat spring assembly embodying features of the invention is illustrated generally at 1410. The seat spring assembly is similar to the first form hereinbefore discussed. It includes a wood front rail 1412 and a wood back rail 1413. Extending between the front rail 1412 and the back rail 1413, parallel to the side rails are a plurality of identical sinuous spring bands 1420, only one of which is shown.

In the seat spring assembly 1410, the forwardmost linear wire segment 1421*a* is seated in a conventional mounting clip 1425 which attaches the band 1420 to the front rail 1412. The clip 1425 includes a hook 1426 in which the wire segment 1421*a* is seated and a horizontally extended attachment section 1427 which is apertured to receive a staple or the like to fasten the clip to the upper surface of the front rail 1412.

In the spring assembly 1410, the rearwardmost linear wire segment 1421*z* is fastened to the back rail 1413 in slightly different fashion. Here a clip 1430 identical to the clip 1425 is fastened to the back rail in the same manner. Seated in the hook 1431 of the clip 1430, however, is a U-shaped link 1432 which, in turn, has hooks 1433 formed at the free ends of each of its two legs 1434. The linear wire segment 1421*z* is seated in the hooks 1433 in the manner illustrated.

According to the invention, a stiff wire span member 1440 spans the frame between the front rail 1412 and the back rail 1413 in this sixth form of the invention and is fastened to these rails at opposite ends. The wire span member 1440 comprises conventional paper-covered wire which is formed downwardly at its front end, as at 1441, and fastened with the aid of staples 1442 to the front surface of the front rail 1412. The member 1440 is fastened to the back rail 1413 through a heavy-load helical spring connector assembly 1443.

The span 1440 is bent back upon itself at its back end and clamped, as at 1444, to form a wire loop 1445. A pair of high-spring resistance helical springs 1450 and 1451, having only six or seven turns, hook into the loop 1445 at corresponding one ends. At their opposite ends the helicals are connected to the rail 1413 by an attachment clip 1453 stapled to the top of the rail.

It will be seen that the front end 1441 of the wire span member 1440 is fastened to the rail on one side of the sinuous spring band while the back end 1443 is fastened to the outer surface of the back rail 1413 on the other side of the band. The effect is to cause the wire member 1440 to pass diagonally under the sinuous spring band.

In fastening the back end 1443 to the back rail 1413, the helical springs 1451 and 1452 are stretched, normally with an attachment tool, and then seated in the clip 1453. As a result the span 1440 is drawn between the rails by a resilient but substantial force. This mounting procedure permits a taut span member to be installed with consistency by semi-skilled personnel.

Mounted on the wire span member 1440 approximately intermediate its ends, and fastened to the sinuous spring band 1420 approximately intermediate its ends, is a "key" member 1450 formed also of paper-covered wire. The "key" member 1450 is bent irregularly in the shape illustrated in FIG. 3 and mounted in position as illustrated in FIGS. 1–3.

In operation of the spring assembly 1410, when a load is imposed on the single sinuous spring band 1420 the downward thrust is communicated through the "key" member 50 to the span member 40. The span member is once again, oil tempered, twelve guage wire which is relatively stiff, fastened rigidly at one end. Since its other end is fastened with a high spring-loading, it still maintains that only a limited; i.e., controlled amount of downward deflection, about three quarters ($\frac{3}{4}$)of an inch, can take place.

While several embodiments described herein are at present considered to be preferred, it is understood that various modifications and improvements may be made therein, and it is intended to cover in the appended claims all such modifications and improvements as fall within the true spirit and scope of the invention.

What is desired to be claimed and secured by Letters Patent of the United States is:

1. A seat spring assembly for an upholstered furniture seat, comprising:

a. a seat frame including a front rail, a back rail, and a side rail, b. an outermost sinuous spring band connected to said front and back rails and extending therebetween in substantially parallel relationship with said side rail, c. said band defining an arc in extending between said front and back rails, d. a normally straight, stiff wire span member extending longitudinally of said outermost band, substantially coextensive therewith between said front and back rails, and subtending said arc, e. one end of said wire span member being fastened to one of said band and one of said front and back rails at a point adjacent said one rail so that said one end of said wire member cannot move longitudinally relative to said fastening point, f. the opposite end of said wire span member being fastened to one of said band and the other of said front and back rails at a point adjacent said other rail, and g. vertically elongated key means disposed between said wire span member and said outermost band and fastened rigidly to both, h. said span member and key means being effective to permit a controlled, limited deflection of said outermost band under normal load.

2. The seat spring assembly of claim 1 further characterized in that:

a. said wire span member passes diagonally under said outermost band as it extends longitudinally of the band between its fastened opposite ends, b. said key means being fastened to said wire member at approximately at midpoint.

3. The seat spring assembly of claim 2 further characterized in that:

a. both said wire span member and said key means are fabricated of paper covered wire.

4. The seat spring assembly of claim 2 further characterized in that:

a. said key means comprises an irregularly shaped piece of paper covered wire, b. said piece of paper covered wire having opposite free ends clamped to said wire span member and a transverse segment intermediate its ends clamped to said outermost spring band.

5. The seat spring assembly of claim 2 further characterized in that:

a. said key means comprises an irrgularly shaped piece of paper covered wire, b. said piece of paper covered wire having opposite free ends clamped to said outermost spring band and an intermediate segment clamped to said wire span member.

6. The seat spring assembly of claim 2 further characterized in that:

a. said key means comprises a segment of said wire span member formed upwardly and engaging said outermost spring band.

7. The seat spring assembly of claim 2 further characterized in that:

a. said key means comprises at least two pieces of paper covered wire, b. each of said paper covered wire pieces being fastened adjacent end to said one outermost spring band and adjacent the other end to said wire span member.

8. The seat spring assembly of claim 1 further characterized in that:

a. said wire span member is fastened to said front rail and said back rail at its opposite ends.

9. The seat spring assembly of claim 8 further characterized in that:

a. said wire span member is fastened to said back rail through helical spring means having a high spring force.

10. The seat spring assembly of claim 1 further characterized in that:

a. said wire span member is fastened to said outermost band at its opposite ends.

* * * * *

UNITED STATES PATENT AND TRADEMARK OFFICE

CERTIFICATE OF CORRECTION

PATENT NO. : 4,247,089

DATED : January 27, 1981

INVENTOR(S) : LAWTON H. CROSBY et al.

It is certified that error appears in the above—identified patent and that said Letters Patent is hereby corrected as shown below:

Change name of Assignee from Morley Furniture Spring Construction to Morley Furniture Spring Corporation.

Column 2, line 53, please insert --10-- after "assembly";

Column 3, line 59, please insert --,-- after "have";

Column 4, line 10, please delete "asembly" and substitute therefor --assembly--;

Column 7, line 31, please insert the word --iron-- after "angle";

Column 10, line 28, please delete "irrgularly" and substitute therefor --irregularly--;

Column 10, line 44, please insert --one-- after "adjacent", and delete "one" after "said".

Signed and Sealed this

*Eighteenth* Day of *August 1981*

[SEAL]

*Attest:*

GERALD J. MOSSINGHOFF

*Attesting Officer*

*Commissioner of Patents and Trademarks*